US005832762A

United States Patent [19]

McDaid

[11] Patent Number: 5,832,762

[45] Date of Patent: Nov. 10, 1998

[54] U-LOCK KEYWAY PROTECTOR

[75] Inventor: Cornelius McDaid, Dorchester, Mass.

[73] Assignee: Kryptonite Corporation, Canton, Mass.

[21] Appl. No.: 921,962

[22] Filed: Sep. 2, 1997

[51] Int. Cl.[6] ..... E05B 17/18

[52] U.S. Cl. ..... 70/455; 70/424; 70/39; 70/38 A

[58] Field of Search ..... 70/38 R, 38 A, 70/39, 54, 55, 56, 423, 424, 455, DIG. 43, DIG. 56

[56] References Cited

U.S. PATENT DOCUMENTS

| | | | |
|---|---|---|---|
| 1,195,808 | 8/1916 | Grgich | 70/423 |
| 1,662,612 | 3/1928 | Junkunc | 70/455 |
| 2,247,592 | 7/1941 | Swift | 70/455 |
| 3,858,419 | 1/1975 | Hampton | 70/55 |
| 4,286,445 | 9/1981 | Sills | 70/455 |
| 4,584,855 | 4/1986 | Burlingame | 70/455 |
| 4,676,084 | 6/1987 | Signorelli | 70/455 |
| 4,918,949 | 4/1990 | Newbold | 70/39 |
| 5,010,746 | 4/1991 | Zane et al. | 70/55 |
| 5,257,517 | 11/1993 | Dale | 70/54 |
| 5,505,064 | 4/1996 | Wang | 70/39 |
| 5,535,609 | 7/1996 | Kuo | 70/455 |
| 5,706,679 | 1/1998 | Zane et al. | 70/55 |

FOREIGN PATENT DOCUMENTS

| | | | |
|---|---|---|---|
| 0476229 | 3/1992 | European Pat. Off. | 70/38 A |
| 861805 | 1/1953 | Germany | 70/455 |
| 3913471 | 3/1990 | Germany | 70/39 |
| 1247753 | 9/1971 | United Kingdom | 70/455 |

*Primary Examiner*—Darnell M. Boucher
*Attorney, Agent, or Firm*—Morse & Altman

[57] ABSTRACT

A U-lock keyway protector comprising a cylindrical tube mounted for rotation on a U-lock crossbar. The keyway protector generates enough friction against the crossbar to allow only manual rotation, and it provides a secure grip for ease in rotation. A keyway aperture allows access to the U-lock keyway when in an unprotective position and denies access when in a protective position. When the U-lock is engaged, a shackle leg extends through a shackle slot, preventing longitudinal movement of the keyway protector along the crossbar. A lip at the edge of the keyway protector limits the distance that the keyway protector can be slipped onto the crossbar and eliminates alignment problems.

32 Claims, 2 Drawing Sheets

U-LOCK KEYWAY PROTECTOR

BACKGROUND OF THE INVENTION

1. Field of the Invention

The present invention relates to bicycle and motorcycle U-locks, more specifically, to a cover for protecting the keyway of a U-lock from the environment.

2. The Prior Art

Since the invention of the bicycle and motorcycle lock comprising a U-shaped shackle and a tubular crossbar, the U-lock has become a favorite. The original U-lock has its keyway, the access point through which a key is used to secure the shackle to the crossbar, at the end of the crossbar. A major improvement in the design of the U-lock occurred when the keyway was moved from the end of the crossbar, where it was vulnerable to attack by someone intent on destroying the lock, to the side of the crossbar between the shackle legs, as described in U.S. Pat. No. 5,010,746. Although much less vulnerable to attack, the side-located keyway is more vulnerable to the environment, particularly dirt and mud, than the end-located keyway of the original U-lock. When not being used to the secure a vehicle, the original U-lock was typically held by a bracket that at least partially protected the keyway from the environment. The side-located keyway does not receive the same protection by a holding bracket. In addition, newer methods for holding U-locks, such as the U-lock holder designed into the bicycle rack of U.S. Pat. No. 5,551,609, provide even less protection for the keyway.

SUMMARY OF THE INVENTION

An object of the present invention is to provide a device for selectively protecting the keyway of a U-lock from the environment.

Another object is to provide a device for protecting the keyway of a U-lock from the environment that protects the keyway until manually removed.

The U-lock keyway protector of the present invention is for use with a U-type lock that has a crossbar and shackle. The crossbar has pair of openings to receive the shackle legs and a keyway between the openings.

The basic keyway protector is a cylindrical tube that fits like a sleeve around the crossbar and is preferably composed of a rigid plastic, such as delrin. The inside diameter of the keyway protector is designed to generate a modest amount of friction with the crossbar outer surface, low enough so that it can be rotated manually about the crossbar but high enough so that it cannot rotate inadvertently. Friction is generated by sizing the keyway protector to fit snugly over the crossbar or roughening the inner surface of the keyway protector.

Preferably, the outer surface of the keyway protector provides a secure grip for ease in rotating. All methods for providing a secure grip are contemplated, including roughening the surface to a gritty texture, knurling with a pattern of grooves, providing a series of protrusions.

The keyway protector has two openings, a keyway aperture and a shackle slot. The keyway aperture is located such that, when the keyway protector is rotated into correct position, the aperture is aligned with the keyway, permitting access to it. The shackle slot is a circumferential slot through which the shackle leg extends when the shackle is installed in the crossbar. The installed shackle prevents the keyway protector from moving longitudinally along the crossbar so that the keyway and keyway aperture remained aligned.

Preferably, at the end of the keyway protector adjacent to the shackle slot, a lip extending radially inward from the edge. The lip limits the distance that the keyway protector can be slipped onto the crossbar and, if the distances are set properly, alignment problems between the keyway and keyway aperture are virtually eliminated.

When the shackle is not installed, the keyway protector is prevented from inadvertently separating from the crossbar by one of four preferred methods. In the first method, keyway protector includes a retainer, a cylindrical component that fits onto the other end of the crossbar. An annular ridge/groove combination keeps that keyway from separating from the crossbar. The second method operates on U-locks where the locking mechanism is secured by a pin. The pin extends slightly outward from the crossbar and into a shallow groove in the inner surface of the keyway protector. Alternatively, a protrusion can be installed on the crossbar to fit into the groove. The third method operates on U-locks that retain the key when the shackle is disengaged. The retained key prevents the keyway protector from inadvertent separation. In the fourth method, the friction generated between the keyway protector and the crossbar great enough to prevent inadvertent separation.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION

Figure 6:
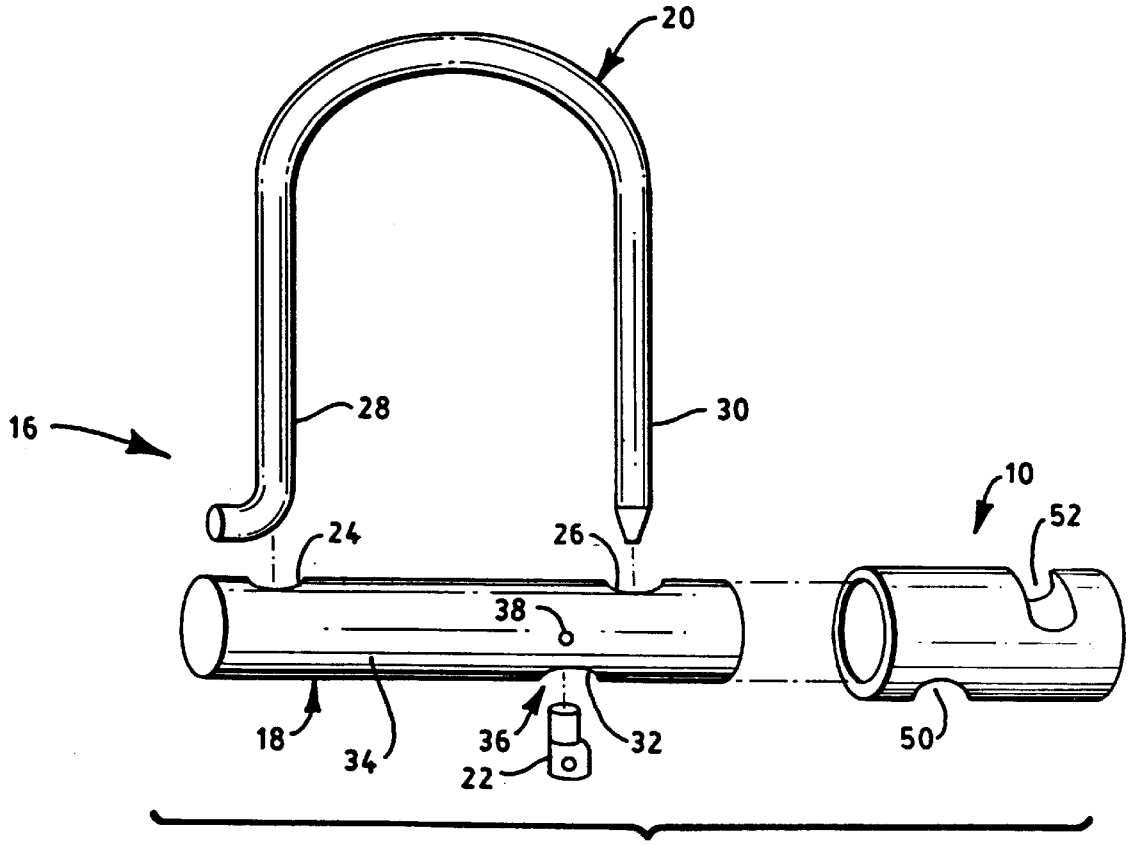
FIG. 6 shows a perspective view of the keyway protector of the present invention with a typical U-lock of the prior art.

The U-lock keyway protector of the present invention is for use with a U-type lock, a example of which is shown in FIG. 6. The U-lock 16 has a crossbar 18 and a shackle 20. The crossbar 18 has a cylindrical shape and a pair of openings 24, 26 in its side to receive the legs 28, 30 of the shackle 20. Between these shackle openings 24, 26 is the keyway 32. Typically, the keyway 32 is located 180° around the circumference of the crossbar 18 from the shackle openings 24, 26, although this location is merely for convenience and may be anywhere around the circumference.

Figure 1:
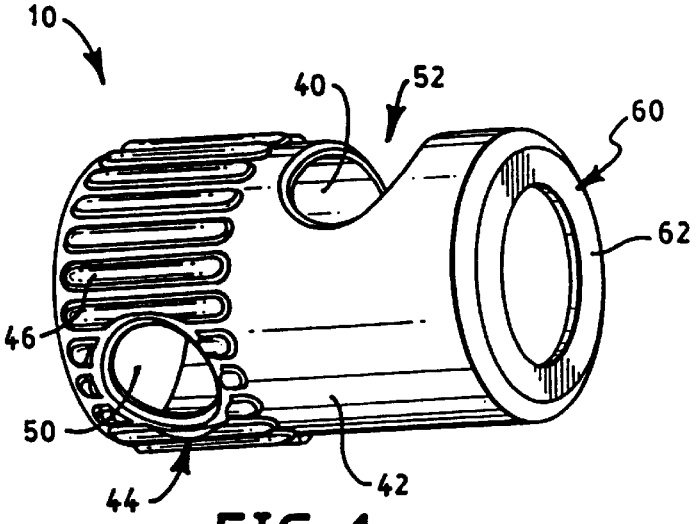
FIG. 1 shows a perspective view of the keyway protector of the present invention.
Figure 2:
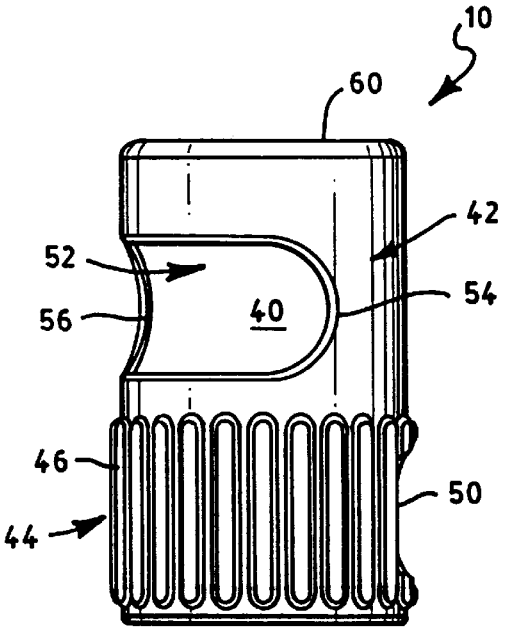
FIG. 2 shows a perspective view of one configuration of the shackle slot of the keyway protector.
Figure 3:
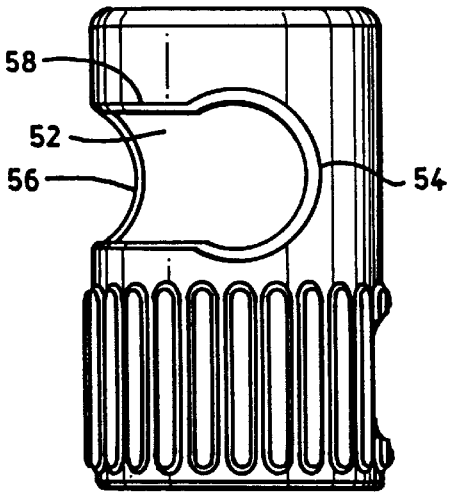
FIG. 3 shows a perspective view of another configuration of the shackle slot of the keyway protector.

The basic U-lock keyway protector of the present invention is shown in FIGS. 1–3. It is a cylindrical tube that fits like a sleeve around the outer surface of the crossbar 18. The body of the key protector is monolithic in nature since it consists of a single component. The inside diameter of the keyway protector 10 is sized and textured such that there is a modest amount of friction between the inner surface 40 of the keyway protector 10 and the crossbar outer surface 34. The amount of friction generated is low enough to permit the keyway protector 10 to be manually rotated about the crossbar 18 but high enough so that the keyway protector 10 cannot rotate independent of manual intervention. This size permits the keyway protector 10 to be manually rotated to a particular position and to maintain that position until manually rotated to another position.

There are two preferred methods for creating the appropriate amount of friction between the keyway protector 10 and the crossbar 18. In one method, the keyway protector 10 sized so that it fits snugly over the crossbar. When this method is used, the inner surface of the keyway protector 10 is preferably substantially smooth. If the inner surface is too rough, too much friction may be created to allow the keyway protector 10 to be rotated manually.

In the second method, the inner surface 40 of the keyway protector 10 is roughened to create friction. This rough inner surface 40 against the relatively smooth crossbar outer surface 34 creates more friction than a smooth inner surface 40 against a smooth crossbar surface 34.

Preferably, a portion of the outer surface 42 of the keyway protector 10 is designed to provide a secure grip for ease in rotating the keyway protector 10. This gripping region 44 only need extend over the area that the user will most likely grip. All methods for providing a gripping region 44 are contemplated by the present invention. Examples of methods include: (1) roughly texturing the outer surface 42 to give it a gritty or sandpaper-like texture; (2) knurling the outer surface 42 by cutting a pattern of narrow grooves, for example, in a cross-cross pattern; and (3) providing the outer surface 42 with protrusions such as bumps and/or ridges 46, as in FIGS. 1–3.

As shown in the figures, there are two openings in the wall of the keyway protector 10, a keyway aperture 50 and a shackle slot 52. The keyway aperture 50 is located in the wall such that, when the keyway protector 10 is rotated about the crossbar 18, the keyway aperture 50 alternately covers and uncovers the keyway 32. Since the purpose of the keyway aperture 50 is to permit access to the keyway 32, the size and shape of the keyway aperture 50 must such access, whether the U-lock 16 is operated by a key, combination, or some other mechanism.

In general, when a sleeve is rotated about a cylinder, it has a tendency to move longitudinally along the cylinder. If this happens with the keyway protector 10 on the crossbar 18, it would cause a misalignment between the keyway 32 and the keyway aperture 50. The user must then hunt for the keyway 32 through the keyway aperture 50, simultaneously rotating and longitudinally moving the keyway protector on the crossbar, an inconvenient exercise. This problem is solved by the shackle slot 52, a circumferential slot through which the shackle leg 30 extends when inserted into the shackle opening 26, shown in two configurations in FIGS. 2 and 3. In the configuration of FIG. 2, the shackle slot 52 is slightly wider than the diameter of the shackle leg 30. When the shackle 20 is installed, the shackle leg 30 extends through the shackle slot 52 into the shackle opening 26. The result is that the keyway protector 10 cannot move longitudinally along the crossbar 18 enough to cause the keyway 32 and keyway aperture 50 to become misaligned when rotated.

The shackle slot 52 provides the secondary function of limiting the arc over which the keyway protector 10 can be rotated. The shackle slot 52 must be at least long enough to provide two positions for the keyway protector 10, a protective position and an unprotective position. In the protective position, the keyway 32 is covered by the wall of the keyway protector 10, and in the unprotective position, the keyway 32 is accessible through the keyway aperture 50. The length of the shackle slot 52 may be such that each position is reached after the keyway protector 10 is rotated until the shackle leg 30 is in contact with an end of the shackle slot 52.

Optionally, the shackle slot 52 can also help retain the keyway protector 10 in either of the two positions. To perform this function, the shackle slot 52 is provided with a slight dumbbell shape, as in FIG. 3. The ends 54, 56 of the shackle slot 52 are wider than the center portion 58, and the center portion 58 is narrow enough so that the shackle leg 30 makes contact with both sides of the shackle slot 52. The wider ends provide locations into which the shackle leg 30 can "snap" as the keyway protector 10 is rotated.

Preferably, the end 60 of the keyway protector 10 nearer to the shackle slot 52 has a lip 62 extending radially inward. The lip 62 provides the function of limiting the distance that the keyway protector 10 can be slipped onto the crossbar 18. If the distance between the lip 62 and the shackle slot 52 is set appropriately, alignment problems are virtually eliminated. The user merely slips the keyway protector 10 onto the end of the crossbar 18 until the lip 62 contacts the end of the crossbar 18. There is no requirement that the lip 62 extend completely around the circumference of the keyway protector 10 or that the lip 62 extend fully inwardly to the axis, creating a closed end. It must only be robust enough to prevent the keyway protector 10 from sliding too far onto the crossbar 18.

Figure 4:
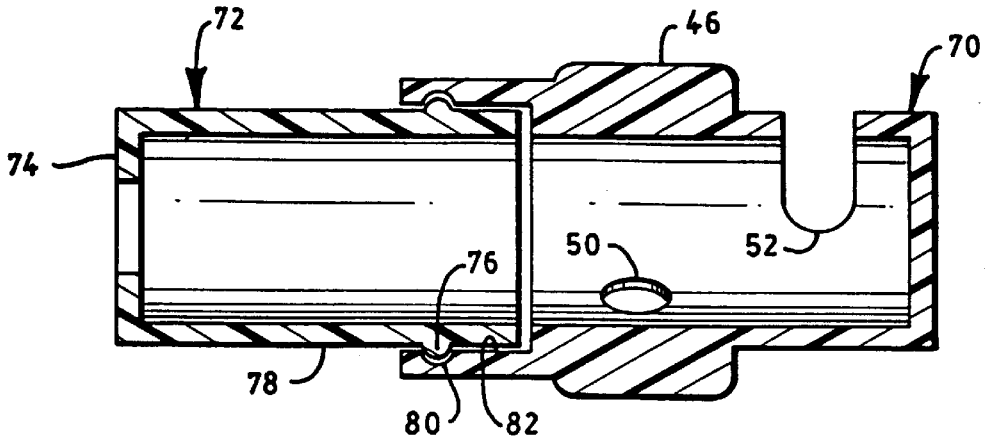
FIG. 4 shows a cross-sectional view of a keyway protector including a retainer for preventing separation of the keyway protector from the U-lock.

When the shackle 20 is not installed, the potential exists for the keyway protector 10 to inadvertently separate from the crossbar 18. There are four preferred methods contemplated by the present invention to prevent this occurrence. The first preferred method uses a cylindrical retainer 72, shown in cross-section in FIG. 4, that fits over the end of the crossbar 18 opposite that of the main component 70 of the keyway protector. The end of the retainer 72 has at least a lip 74, and preferably a closed surface, that contacts the end of the crossbar 18 to prevent the retainer 72 from sliding completely onto the crossbar 18. The retainer 72 has an annular ridge 76 extending from the outer surface 78. This ridge 76 mates with an annular groove 80 in the inner surface 82 of the main component 70. In an alternate configuration, the annular groove is in the outer surface of the retainer and the annular ridge is on the inner surface of the main component. In order for the ridge 76 and groove 80 to mate, the main component 70 must fit over the retainer 72. To that end, the inside diameter of the main component 70 is stepped such that the inside diameter at the apertures 50, 52 is as described above and the inside diameter at the retainer 72 is the same as the outside diameter of the retainer 72.

Figure 5:
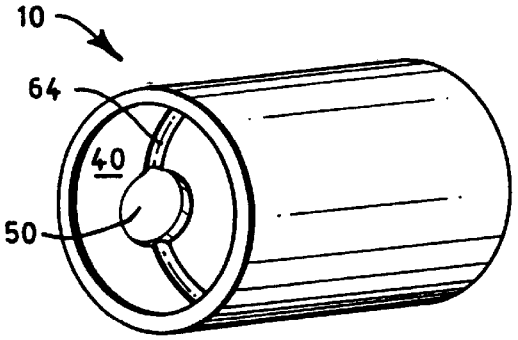
FIG. 5 shows a perspective view of the keyway protector incorporating another preferred method for preventing inadvertent separation of the keyway protector from the U-lock.

The second preferred method depends upon the construction of the U-lock 16. In some U-locks 16, the locking mechanism 36 is secured within the crossbar by a pin 38, shown in FIG. 6, that is force-fit into the wall of the crossbar 18. In order to prevent inadvertent separation of the keyway protector 10 from the crossbar 18, the pin 38 extends slightly outward from the crossbar outer surface 34 and the keyway protector inner surface 40 is provided with a shallow, circumferential groove 64, shown in FIG. 5, in which the pin 38 resides. The groove 64 permits the keyway protector 10 to rotate and the pin 38 residing within the groove 64 prevents inadvertent separation of the keyway protector 10 from the crossbar 18. Alternatively, if the U-lock 16 is not provided with a pin 38, a protrusion can be permanently installed on the crossbar outer surface 34 to be received by the groove 64.

The third method depends upon the operation of the U-lock locking mechanism 36. In some U-lock designs, when the locking mechanism 36 is disengaged to permit removal of the shackle 20, the locking mechanism 36 retains the key 22. The retained key 22 prevents the keyway protector 10 from inadvertent separation.

The fourth method is to make the friction between the inner surface of the keyway protector and the outer surface of the crossbar 18 great enough to prevent inadvertent separation.

Preferably, the keyway protector 10 is composed of a rigid material. The most preferred material is a rigid plastic, such as delrin, so that keyway protector 10 can be manufactured relatively easily and inexpensively.

OPERATION

As shown in FIG. 6, the keyway protector 10 is installed on the U-lock 16 by sliding it onto one end of the crossbar 18 and rotating it until the shackle slot 52 is aligned with the shackle opening 30. After the shackle 20 is installed, the keyway protector 10 is rotated until the keyway aperture 50 is aligned with the keyway 32 and then the U-lock 16 is locked. After locking, the keyway protector 10 is rotated so that the keyway 32 is covered. To open the U-lock 16, the keyway protector 10 is rotated until the keyway aperture 50 is aligned with the keyway 32, permitting access to the keyway 32.

Thus it has been shown and described a U-lock keyway protector which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A keyway protector for use with a U-lock, said keyway protector comprising:

(a) a monolithic cylindrical tubular body having an inner surface, an outer surface, and a circumference;

(b) said body having a keyway aperture;

(c) said body having a slot elongated about said circumference;

(d) said body being adapted for mounting for rotational movement about a cylindrical crossbar of said U-lock between an unprotective position and a protective position, said unprotective position being such that said keyway aperture is adapted for alignment with a keyway of said crossbar, thereby permitting access to said keyway, and said-protective position being such that said body is adapted to cover said keyway, thereby preventing access to said keyway; and (e) said body being adapted for prevention from substantial longitudinal movement along said crossbar by a leg of a shackle of said U-lock extending through said slot into an opening in said crossbar.

2. The keyway protector of claim 1 wherein at least manual force is necessary to rotate said body between said protective position and said unprotective position.

3. The keyway protector of claim 1 wherein said slot has two opposed extremities and wherein said body is adapted to be in said protective position when said shackle leg is at a first of said two extremities and said body is adapted to be in said unprotective position when said shackle leg is at a second of said two extremities.

4. The keyway protector of claim 1 wherein said outer surface is provided with a gripping region.

5. The keyway protector of claim 4 wherein said gripping region includes protrusions.

6. The keyway protector of claim 4 wherein said gripping region includes rough texturing.

7. The keyway protector of claim 4 wherein said gripping region includes grooves.

8. The keyway protector of claim 1 wherein a lip extends radially inward from an edge of said body adjacent to said slot.

9. The keyway protector of claim 1 wherein said inner surface includes a circumferential groove adapted to receive a pin extending radially outward from said crossbar, said body being adapted for prevention from inadvertent longitudinal movement along said crossbar when said pin is received in said groove.

10. The keyway protector of claim 1 wherein said keyway protector includes a cylindrical retainer having an outer surface, a hole, a lip extending radially inward from an edge, and being adapted for mounting on said crossbar at an end distant from said opening such that said hole is adapted to be aligned with another crossbar opening, said retainer and said body having a mating configuration to prevent said body from inadvertent longitudinal movement along said crossbar.

11. The keyway protector of claim 10 wherein said mating configuration includes said retainer outer surface having an annular ridge and a said body inner surface having a mating annular groove.

12. The keyway protector of claim 10 wherein said mating configuration includes said retainer outer surface having an annular groove and a said body inner surface having a mating annular ridge.

13. A keyway protector for use with a U-lock having a shackle and cylindrical crossbar, said shackle including a first leg and a second leg, said crossbar including a first opening for receiving said first leg, a second opening for receiving said second leg, and a keyway between said first opening and said second opening, said keyway protector comprising:

(a) a monolithic cylindrical tubular body having an inner surface, an outer surface, and a circumference, said outer surface being provided with a gripping region;

(b) said body having a keyway aperture;

(c) said body having a slot elongated about said circumference;

(d) said body being mounted for rotational movement about said crossbar between an unprotective position and a protective position, said unprotective position being when said keyway aperture is aligned with said keyway, permitting access to said keyway, and said protective position being when said keyway is substantially covered by said body, preventing access to said keyway;

(e) at least manual force being necessary to rotate said body between said protective position and said unprotective position; and (f) said body being prevented from substantial longitudinal movement along said crossbar by said first leg extending through said slot into said first opening.

14. The keyway protector of claim 13 wherein said slot has two opposed extremities and wherein said body is adapted to be in said protective position when said shackle leg is at a first of said two extremities and said body is adapted to be in said unprotective position when said shackle leg is at a second of said two extremities.

15. The keyway protector of claim 13 wherein said gripping region includes protrusions.

16. The keyway protector of claim 13 wherein a lip extends radially inward from an edge of said body adjacent to said slot.

17. The keyway protector of claim 13 wherein said inner surface includes a circumferential groove adapted to receive a pin extending radially outward from said crossbar, said body being adapted for prevention from inadvertent longitudinal movement along said crossbar when said pin is received in said groove.

18. The keyway protector of claim 13 wherein said keyway protector includes a cylindrical retainer having an outer surface, a hole, a lip extending radially inward from an edge, and being adapted for mounting on said crossbar at an end distant from said opening such that said hole is adapted to be aligned with another crossbar opening, said retainer and said body having a mating configuration to prevent said body from inadvertent longitudinal movement along said crossbar.

19. The keyway protector of claim 18 wherein said mating configuration includes said retainer outer surface having an annular ridge and a said body inner surface having a mating annular groove.

20. The keyway protector of claim 18 wherein said mating configuration includes said retainer outer surface having an annular groove and a said body inner surface having a mating annular ridge.

21. A keyway protector for use with a U-lock, said keyway protector comprising:

(a) a monolithic cylindrical tubular body having an inner surface, an outer surface, and a circumference, said outer surface being provided with a gripping region that includes protrusions;

(b) said body having a keyway aperture;

(c) said body having a slot elongated about said circumference, said slot having two opposed extremities;

(d) said body having a lip that extends radially inward from an edge of said body adjacent to said slot;

(e) said body being rotatable between an unprotective position and a protective position, said unprotective position being when a shackle leg of the U-lock is at a first of said two extremities and said keyway aperture is adapted to be aligned with said keyway, thereby permitting access to said keyway, and said protective position being when said shackle leg is at a second of said two extremities and said body is adapted to substantially cover said keyway, thereby preventing access to said keyway;

(f) at least manual force being necessary to rotate said body between said protective position and said unprotective position; and (g) said body being adapted for prevention from substantial longitudinal movement along said crossbar by a leg of a shackle of said U-lock extending through said slot into an opening in said crossbar.

22. The keyway protector of claim 21 wherein said inner surface includes a circumferential groove adapted to receive a pin extending radially outward from said crossbar, said body being adapted for prevention from inadvertent longitudinal movement along said crossbar when said pin is received in said groove.

23. The keyway protector of claim 21 wherein said keyway protector includes a cylindrical retainer having an outer surface, a hole, a lip extending radially inward from an edge, and being adapted for mounting on said crossbar at an end distant from said opening such that said hole is adapted to be aligned with another crossbar opening, said retainer and said body having a mating configuration to prevent said body from inadvertent longitudinal movement along said crossbar.

24. The keyway protector of claim 23 wherein said mating configuration includes said retainer outer surface having an annular ridge and a said body inner surface having a mating annular groove.

25. The keyway protector of claim 23 wherein said mating configuration includes said retainer outer surface having an annular groove and a said body inner surface having a mating annular ridge.

26. A keyway protector and U-lock combination comprising:

(a) said U-lock including a shackle and cylindrical crossbar, said shackle including a first leg and a second leg, said crossbar including a first opening for receiving said first leg, a second opening for receiving said second leg, and a keyway between said first opening and said second opening;

(b) said keyway protector including a monolithic cylindrical tubular body having an inner surface, an outer surface, and a circumference;

(c) said body having a keyway aperture;

(d) said body having a slot elongated about said circumference;

(e) said body being mounted for rotational movement about said crossbar between an unprotective position and a protective position, said unprotective position being such that said keyway aperture is substantially aligned with said keyway, thereby permitting access to said keyway, and said protective position being such that said body substantially covers said keyway, thereby preventing access to said keyway; and (f) said body being prevented from substantial longitudinal movement along said crossbar by said first leg extending through said slot into said first opening.

27. The combination of claim 26 wherein said slot has two opposed extremities and wherein said body is in said protective position when said first leg is at a first of said two extremities and said body is in said unprotective position when said second leg is at a second of said two extremities.

28. The combination of claim 26 wherein at least manual force is necessary to rotate said body between said protective position and said unprotective position.

29. The combination of claim 26 wherein said outer surface is provided with a gripping region.

30. The combination of claim 26 wherein a lip extends radially inward from an edge of said body adjacent to said slot.

31. The combination of claim 26 wherein said crossbar includes a pin extending radially outward and said inner surface includes a circumferential groove adapted to receive said pin, said body being prevented from longitudinal movement along said crossbar when said pin is received in said groove.

32. The combination of claim 26 wherein said keyway protector includes a cylindrical retainer having an outer surface, a hole, a lip extending radially inward from an edge, and being mounted on said crossbar at an end adjacent to said second opening such that said hole is aligned with said second opening, said retainer and said body having mating configurations to prevent said keyway protector from inadvertent longitudinal movement along said crossbar.

* * * * *